United States Patent [19]

Hansen et al.

[11] 4,115,750

[45] Sep. 19, 1978

[54] BIMETAL ACTUATOR

[75] Inventors: Niels Junior Hansen, Camp Hill; John Ambrose Ward, Carlisle; William Hintze, Camp Hill, all of Pa.; David Charles Johnson, Winston-Salem, N.C.

[73] Assignee: AMP Incorporated, Harrisburg, Pa.

[21] Appl. No.: 612,888

[22] Filed: Sep. 12, 1975

Related U.S. Application Data

[63] Continuation of Ser. No. 405,223, Oct. 10, 1973, abandoned.

[51] Int. Cl.[2] ..... H01H 61/02

[52] U.S. Cl. ..... 337/107; 337/377; 338/289; 338/309

[58] Field of Search ..... 337/107, 377; 338/283, 338/288, 289, 291, 309

[56] References Cited

U.S. PATENT DOCUMENTS

| | | | |
|---|---|---|---|
| 2,800,555 | 7/1957 | Sundt | 337/107 |
| 3,316,374 | 4/1967 | Nelson | 337/107 |
| 3,452,314 | 6/1969 | Sapoff et al. | 338/309 |
| 3,842,382 | 10/1974 | Bell | 337/107 |
| 3,921,118 | 11/1975 | Ratzlaff | 338/283 |

*Primary Examiner*—George Harris
*Attorney, Agent, or Firm*—Russell J. Egan

[57] ABSTRACT

An improved bimetal actuator is disclosed. A thin film resistor is fixed to the high expansion side of a bimetal element and, when energized, generates sufficient heat to actuate the bimetal. The resistor has a serpentine configuration formed by a continuous series of loops, each successive loop having a greater width from the fixed to the free end of the bimetal, to provide differential heating of the bimetal and thus a greater movement of its free end for the power dissipated in the resistor.

9 Claims, 2 Drawing Figures

BIMETAL ACTUATOR

This is a continuation of application Ser. No. 405,223, filed Oct. 10, 1973 now abandoned.

BACKGROUND OF THE INVENTION

1. The Field Of The Invention

The present invention relates to a bimetallic actuator and in particular to an actuator which produces a greater amount of motion for the power dissipated.

2. The Prior Art

Most well known bimetal actuators are comprised of a bimetal element and a heater element. The heater is usually an insulated resistance wire wound around the bimetal element. When current is passed through the wire, it heats and causes the bimetal element to likewise be heated and move. However, this arrangement is not particularly efficient since there is quite a bit of heat loss between the wire and the bimetal element since the round wire only makes a relatively thin line contact with the bimetal element.

SUMMARY OF THE INVENTION

The subject bimetal actuator includes a bimetallic element and a thin film resistor of serpentine configuration with the coils or loops thereof being progressively wider from one end of the resistor to the other end. The resistor is formed on a thin flexible plastic substrate, such as Kapton, with the separate loops or coils formed thereon by any of the well known plating techniques. The resistor is then fixedly adhered to the high expansion side of the bimetal with the wider loops towards its free end.

It is an object of the invention to produce an improved bimetal actuator which has better heat transfer between the bimetal element and heater and thus achieves a greater amount of movement of the bimetal element for the power dissipated.

It is a further object of the present invention to produce a bimetal actuator in which a thin film resistor differentially heats a bimetal element to produce a greater movement of the free end of the bimetal element.

It is a still further object of the present invention to use a non-linear graded resistor to so distribute the dissipated heat as to maximize the efficiency by concentrating the region of high temperature and thus the bimetal expansion to provide maximum deflection per unit of power dissipated.

It is yet another object of the present invention to produce a bimetal actuator which can be readily and economically produced.

The foregoing objects and other advantages of the present invention will become apparent from the following detailed description taken with reference to the accompanying drawings.

DETAILED DESCRIPTION OF THE PREFERRED EMBODIMENT

Figure 1:
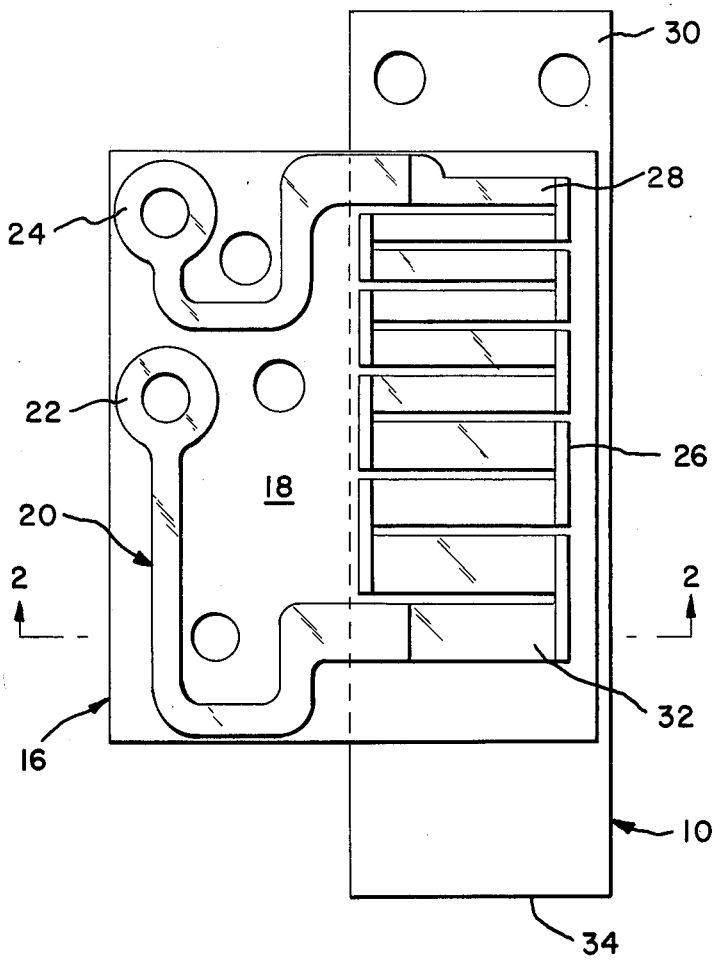
FIG. 1 is a plan view of the present bimetal actuator mounted on a bimetallic element.
Figure 2:
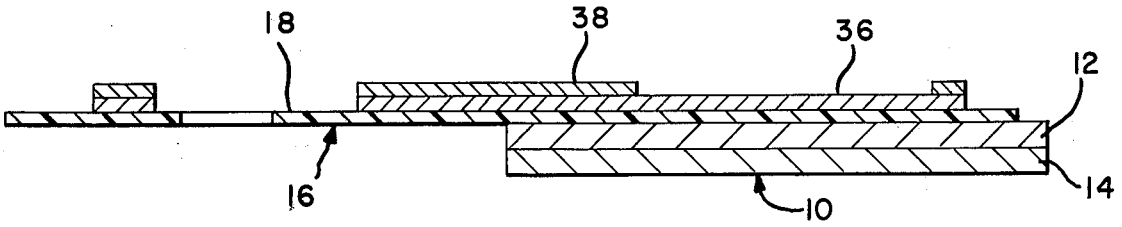
FIG. 2 is a vertical transverse section, on an exaggerated scale, taken along the line 2—2 of FIG. 1.

The bimetallic element 10 is comprised of two metal layers 12, 14 having different coefficients of thermal expansion laminated together in any manner well known in the art. A thin film resistor member 16 is formed by a flexible thin film substrate 18 having a resistance circuit 20 formed thereon. The thin film 18 may be selected from any of the well known materials, such as Mylar, and the resistance circuit 20 can be formed thereon by any of the well known processes, such as printing or etching. The resistance circuit 20 includes terminals 22, 24 and an intermediate resistor portion 26 which has a serpentine configuration. The individual loops or coils of the serpentine portion vary progressively in width from being relatively narrow at coil 28, adjacent the mounting end of the bimetallic element 30, to being rather wide at coil 32, adjacent the free end 34 of the bimetallic element. The thin film resistor 16 is secured to the bimetallic element by conventional means, such as adhesives.

The application of power across terminals 22, 24 causes the resistance circuit 20 to generate a large amount of the heat. Because of the large surface-to-surface contact area between the circuit 20 and bimetal element 10, almost half of the heat produced is transferred directly to the bimetallic element. This contact surface area is far greater than that of conventional round wire which makes only a thin line contact when wrapped on a bimetal element. The present resistor member 16 will, because of the different widths of the loops, produce a greater amount of heat towards the fixed end 30 of the bimetal 10 and thus a greater deflection of the free end 34.

As a specific example of the present bimetallic actuator, the thin film resistor member 16 was formed by electroless deposition of a continuous nickel phosphorus layer 36 on the obverse (front) side of a flexible insulating polyimide film 18, such as Kapton. The nickel was coated with a photoresist material and etched, in a conventional manner, to produce the resistance circuit 20. An additional layer of copper 38 was plated on the terminal lead portions of the circuit and to interconnect the ends of the loops. This additional layer was added to define the portions of the resistance circuit which will generate the desired heating and to eliminate the sharp corners in the circuit, which normally cause high density current crowding generating hot spots. The bimetallic element had a low expansion side composed of 64% Iron and 36% Nickel and a high expansion side composed of 72% Manganese, 18% Copper, and 10% Nickel. The bimetallic element was $1\frac{5}{8}$ inches long with an effective lever arm of $1\frac{3}{8}$ inches. After appropriate heat treatment to stabilize the resistors, the reverse side of substrate and high expansion side of the bimetallic element was coated with an epoxy adhesive. The circuit was then bonded to the bimetallic element by bringing the two adhesive coated surfaces together under heat and pressure to cross link the adhesive layers. The assembly was post cured for adequate time to complete the cure of the epoxy adhesive.

The bimetallic actuator constructed according to the above was fixedly mounted by one end, energized and the defection of the other end was measured. It was found that application of about 3.5 watts caused about 120 mils deflection while 4.7 watts caused a 190 mil deflection. This compares to a standard wire wound bimetal actuator of similar dimensions achieving only 124 mils of deflection for the application of 4.7 watts of power.

The subject bimetal actuator can also be assembled with the resistance circuit positioned against the bimetallic element and with a radiation shield (not shown)

fixed to the reverse of the flexible substrate. This arrangement further improves the heat transfer from the resistance circuit to the bimetallic element. However, this arrangement is generally only available when the actuator is to be used at temperatures lower than 400° C. because of the properties of conventional adhesives used to attach the radiation shield to the flexible substrate.

The subject bimetal actuator can also be formed with the bimetal having a disc or other regular geometric shape. This bimetal would be mounted for restrained movement on at least two opposite sides so that the expansion will cause deflection of a central part of the bimetal. The thin film resistor for this embodiment can have loops of a first narrow width near each restrained side of the bimetal and loops of a second wider width intermediate the end loops.

The present invention is subject to many modifications and changes without departing from the spirit or essential characteristics thereof. The above discussed embodiment should therefore be considered in all respects as being merely illustrative and not restrictive.

What is claimed is:

1. An improved bimetallic actuator including:

a bimetallic element comprising two metal members of different coefficients of thermal expansion bonded together, said bimetallic element adapted to be fixedly mounted by at least one side; and a thin film resistor bonded to the high expansion side of said bimetal, said resistor including a thin film insulating substrate with a non-linear resistive circuit plated thereon in a serpentine configuration formed by a pair of spaced terminals interconnected by a continuous series of loops, each successive loop having a greater width than the preceeding adjacent loop from a first narrow width at the at least one fixed side of the bimetallic element to a second greater width remote from the at least one fixed side, whereby said element is differentially heated.

2. An improved bimetallic actuator according to claim 1, wherein:

said resistor comprises an electrolessly deposited continuous nickel phosphorus layer on one side of a polyimide film etched to form the serpentine configuration, and a copper layer on the terminals and those portions of the circuit spanning the ends of the loops whereby sharp corners and thus hot spots are eliminated.

3. An improved bimetallic actuator according to claim 1 wherein said bimetallic element is rectangularly shaped and mounted in cantilever fashion.

4. A thin film resistor comprising:

a thin film of flexible insulative material;

a layer of resistive material adhered to said film and defining at least first and second terminals integral with and spaced along an intermediate resistor portion, said resistive material having a predetermined electrical resistance per unit area; and a layer of conductive material adhered to at least said terminals and overlapping adjacent portions of said intermediate resistor portion.

5. A thin film resistor according to claim 4 wherein said thin film is a polyimide.

6. A thin film resistor according to claim 4 wherein said layer of resistive material is nickel phosphorus.

7. A thin film resistor according to claim 4 wherein said layer of conductive material is copper.

8. A thin film resistor according to claim 4 wherein said resistive layer comprises a plurality of spaced, parallel straight sections, and said layer of conductive material interconnects alternate adjacent ends of said resistive sections.

9. A thin film resistor according to claim 7 wherein said insulative material is a flexible plastic material, and said conductive material is copper forming flexible extended terminals.

* * * * *